United States Patent [19]

Fox et al.

[11] Patent Number: 5,070,809

[45] Date of Patent: Dec. 10, 1991

[54] KINETIC BANNER DISPLAY

[76] Inventors: David W. Fox; Carla M. Fox, both of 20410 Sweetbriar Rd., West Linn, Oreg. 97306

[21] Appl. No.: 696,512

[22] Filed: May 7, 1991

[51] Int. Cl.[5] ..... G09F 17/00

[52] U.S. Cl. ..... 116/174; 116/173; 248/156; 248/289.1

[58] Field of Search ..... 116/173, 174; 40/412, 40/413, 439, 440, 441, 602; 248/156, 289.1, 290, 545

[56] References Cited

U.S. PATENT DOCUMENTS

| | | | |
|---|---|---|---|
| 925,206 | 6/1909 | Lindhorst | 116/174 |
| 975,114 | 11/1910 | Blank | 116/174 |
| 1,383,234 | 6/1921 | Raugse | 116/173 |
| 2,072,573 | 3/1937 | Vigliotti | 116/173 |
| 3,081,734 | 3/1963 | Spahl | 116/173 |
| 4,770,655 | 10/1987 | Kirby | 116/174 |
| 4,880,195 | 11/1989 | Lepley | 248/219.4 |

*Primary Examiner*—William A. Cuchlinski, Jr.
*Assistant Examiner*—W. Morris Worth
*Attorney, Agent, or Firm*—Edward B. Watters

[57] ABSTRACT

Vertically oblong fabrics panels displaying promotional graphics mounted pivotally on a frame enabling the panels to rotate as wind vanes kinetically displaying the graphics. The apparatus, which displays graphics like a banner but emulates the kinetic properties of a flag, is termed a Flanner.

9 Claims, 2 Drawing Sheets

KINETIC BANNER DISPLAY

BACKGROUND OF THE INVENTION

This invention relates to display devices, and more particularly to a banner mounted for kinetic display of graphics in an outdoor setting.

Banners and flags have long been used to herald or identify certain constituencies and for symbolic displays, and they have considerable esthetic appeal when used as decoration.

Businesses, municipalities and other promoters of both private and public establishments, events, observances, celebrations, sports activities and the like, often advertise and publicize the event or enterprise by placing banners that display artwork portraying or announcing the happening, in and around the locale of the event or business. Fixed or static banners are often subject to wind loads that can tear the banner or stress and damage the supporting structure or fasteners holding the banner, necessitating perforation of the banner with unsightly holes or pots to decrease the wind load. Various support structures, adjunct to a flagpole and consisting generally of metal rods laced or otherwise linked to the edges of a flag, have been used to hold flags in an extended position in the absence of wind; however, such structures have been found to provide inadequate support because in most instances the extended dimension or fly of a flag is of considerably greater length than that of the height or hoist.

Accordingly, it is a principle object of the invention to provide an improved banner display and support apparatus therefor.

Another object of the invention is to provide improved display apparatus that incorporates the kinetics and movement of a flag while exhibiting graphics as a banner.

A further object of the invention is to provide a graphics bànner display and support apparatus adapted for rotation of the banner before the wind.

Another object of the invention is to provide kinetic banner display apparatus that is quickly and easily assembled and mounted for exhibit.

SUMMARY

The present invention provides an elongate banner substantially greater in height than width and attached to a frame, which is pivoted to allow 360 degree rotation of the banner. The frame employs a tubular vertically-mounted standard and a substantially horizontal arm pivotally mounted atop the vertical standard. The banner hangs from the horizontal arm by fabric loops attached to the top edge of the banner, and is loosely attached to the tubular vertical member by loops similarly affixed to ane side of the banner. Incorporating the kinetics of a flag while exhibiting graphics as a banner, the device is termed herein a "Flanner".

BRIEF DESCRIPTION OF THE DRAWING

While the invention is set forth with particularity in the appended claims, other objects, features, the organization and method of operation of the invention will become more apparent, and the invention will best be understood by referring to the following detailed description in conjunction with the accompanying drawing in which:

DESCRIPTION OF THE PREFERRED EMBODIMENT

Figures 1, 5:
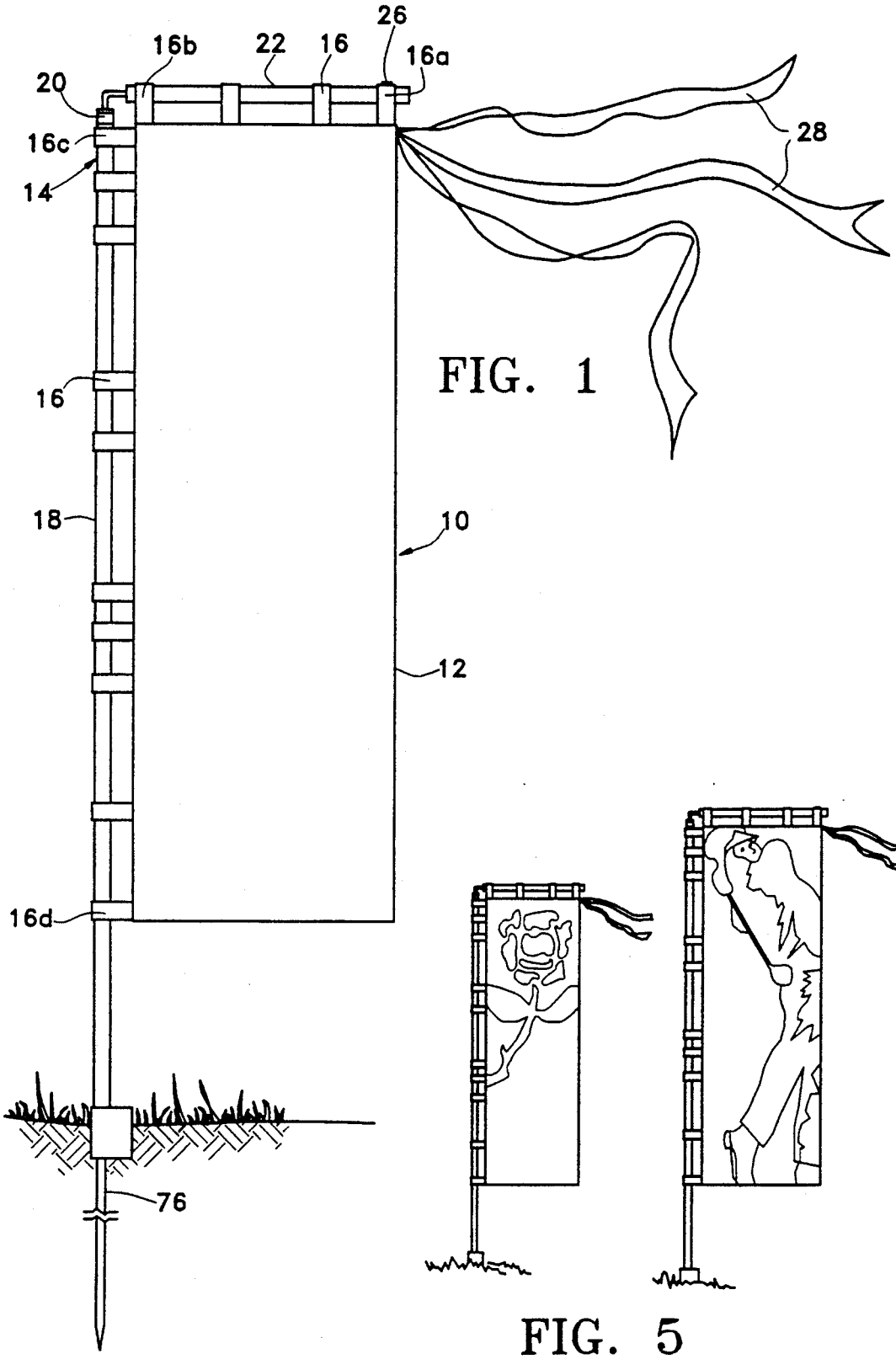
FIG. 1 is a front elevation of a kinetic banner display or Flanner in accordance with the invention.
FIG. 5 is a pictorial veiw of grouping of Flanners according to the invention.

Referring now to the various views of the drawing for a more detailed description of the components, materials, construction, function, operation and other features of the instant invention by characters of reference, a Flanner or kinetic banner display 10 comprises a fabric panel 12 supported on a frame 14 by looped straps 16 sewn or otherwise suitably attached to the panel 12 along the top and one side edge thereof. The frame 14 includes a vertical standard 18, a pivot 20 atop the standard 18 and an arm 22 extending generally horizontally outward from the pivot 20, the vertical standard 18 and arm 22 passing through the looped straps 16. The standard 18 and arm 22 are suitably made from lengths of copper or thin-wall steel tubing. The looped straps 16 of the panel 12 are required for stability at the corners of the panel, as indicated in FIG. 1 by reference numbers 16*a*–16*d*; other straps 16 can be spaced evenly along the top and side of the panel, or grouped unevenly as shown in FIG. 1 to enhance the esthetics of the Flanner. A suitable fastener 24 such as a sheet metal screw installed through a grommet 26 the end strap 16*a* provides a means for holding the panel 12 extended on the horizontal arm 22 of the frame 14. Streamers 28 attached to the outer edge of the panel sail outward before the wind enhancing the display.

Figure 2:
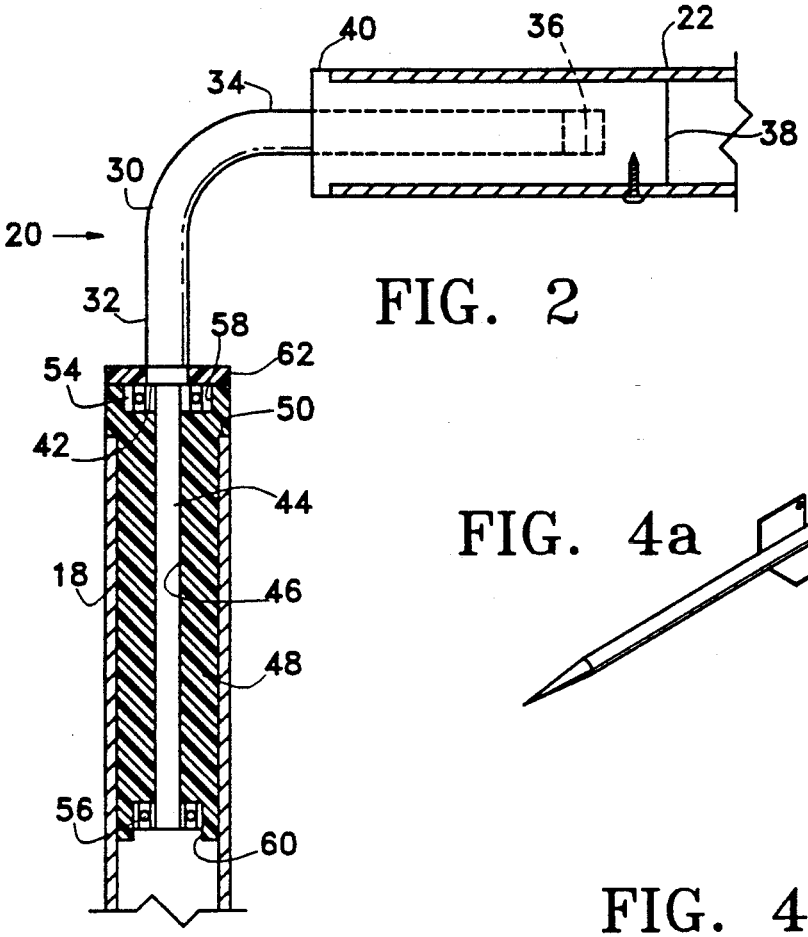
FIG. 2 is a section veiw of the pivot of the Flanner of FIG. 1.

Referring to FIGS. 1 and 2, the pivot 20 comprises a metal rod 30, suitably of stainless steel, bent to form a vertical leg 32 and an extended leg 34 at an included angle of approximately 95 degrees. The angle can be varied according to the length of the arm 22, which supports the panel 12, and the type and weight of fabric used to fashion the panel 12, such that when the panel 12 is installed on the arm 22, the weight of the panel bearing on the arm stresses the rod 30 to a normal configuration of the vertical and extended legs. A variety of materials may be utilized to make the panel, the preferred material; being heavy nylon or a light-weight awning material; fabric too heavy will tend to pull the extended arm 22 down, below a horizontal orientation. The arm 22 preferably extends outward from the pivot 20 no further than 30 inches, while the vertical standard 18 can range in height from 5 to 15 feet.

The extended leg 34 of the rod 30 is closely fitted and pressed into a central bore 36 of a cylindrical plug 38, which in turn is closely fitted inside the proximal end of the tubular arm 22. A flange 40 formed at the end of the plug 38 abuts the proximal end of the arm 22. The plug 38 is suitably formed from a rigid plastic material such as nylon or polystyrene.

Figure 3:
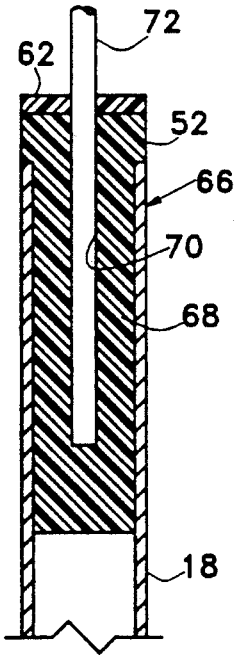
FIG. 3 illustrates an alternative embodiment of the pivot.

The vertical leg 32 of the rod 30, which is stepped 42 to a smaller diameter forming a spindle 44, extends through a central bore 46 of a cylindrical bearing block 48. The diameters of the spindle 44 and the bore 46 are such that the spindle fits loosely in passing through the bore 46 to allow free rotation of the spindle 44. The cylindrical bearing block 48 is inserted and fitted closely into the top end 50 of the vertical standard 18, and a flange 52 formed at the upper end of the bearing block 48 abuts and resets on the top end 50 of the vertical standard 18. Bearings 54, 56, which engage the spindle 44, are pressed into counterbores 58, 60 formed in either end of the cylindrical bearing block 48. The step 42 of the vertical leg 32 bears on the upper bearing 54, which is suitably a thrust bearing. A seal 62 protects the pivot 20 from moisture and contaminants such as blowing dust or dirt. In an alternative embodiment of the invention, illustrated in FIG. 3, the pivot 66 includes a cylindrical bearing block 68 having a central bore 70 which extends only partially through the length of the bearing block 68, and the vertical leg 72 of the rod 74 is journaled in the bore 70 of the bearing block 68. In either of the above described embodiments of the pivot, the cylindrical bearing block is suitably formed from a rigid plastic material such as Teflon of nylon, which may be filled or reinforced for strength as with glass.

Figure 4A:
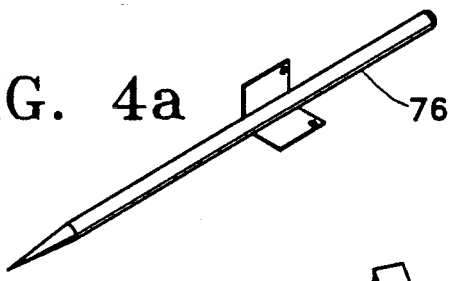
FIGS. 4*a*–4*c* illustrate the various base mounts of the Flanner according to the invention.
Figure 4B:
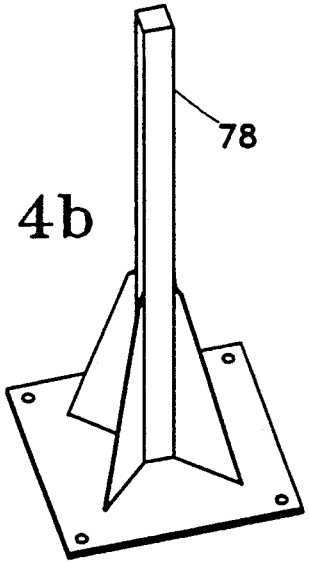
Figure 4C:
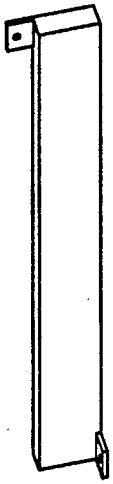

The vertical standard 18 can be erected and held in place by a variety of conventional base mounts as illustrated in FIGS. 1 and 4*a*–4*c*: FIG. 4*a* and FIG. 1 illus trate a ground mount 76 for erecting the banner display in a grassy area and in firm soil; FIG. 4*b* illustrates a box mount 78 for erecting the banner on a planar surface such as a deck or a concrete or asphalt surface; and FIG. 4*c* shows a vertical surface mount for erecting the standard on a low wall or railing.

Erected in groups as shown in FIG. 5, Flanners provide a kinetic display of graphics turning in unison with the wind, the rotation drawing the eyes of viewers to the synchronized movement.

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

We claim:

1. A kinetic banner display, comprising:

frame including a vertically mounted standard, a pivot atop the standard, and an arm extending outward substantially horizontally from the pivot; and a rectangular panel secured to the frame, the panel and having a height substantially greater than its width, the panel being made of a flexible fabric and including looped straps affixed to corners of the panel on and normal to a top edge and one side edge of the panel, the panel being suspended from the outward extending arm of the frame by the looped straps on the top edge of the panel and loosely attached to the standard by the looped straps on the one side edge of the panel to allow rotation of the panel about the standard as the outward extending arm rotates about the pivot.

2. The kinetic banner display according to claim 1 further comprising a plurality of additional looped straps spaced along the top edge and the one side edge of the panel further securing the panel to the frame.

3. The kinetic banner display according to claim 1 further comprising a streamer attached to an outer edge of the panel.

4. A kinetic banner display, comprising:

a frame including a vertically mounted standard, a pivot atop the standard, and an arm extending outward from the pivot at an angle slightly above horizontal; and a rectangular panel secured to the frame, the panel having a height substantially greater than its width, the panel being made of flexible fabric and including looped straps affixed to corners of the panel on and normal to a top edge and one side edge of the panel, the panel being suspended from the outward extending arm by the looped straps on the top edge of the panel and loosely attached to the standard by the looped straps on the one side edge of the panel to allow rotation of the panel about the standard as the outward extending arm rotates about the pivot, the panel having a weight such that the weight of the panel bearing on the arm stresses the arm to a normal orientation with respect to the vertically mounted standard.

5. The kinetic banner display according to claim 4 further comprising a plurality of additional looped straps spaced along the top edge and the one side edge of the panel further securing the panel to the frame.

6. The kinetic banner display according to claim 4 further comprising a streamer attached to an outer edge of the panel.

7. A kinetic banner display, comprising:

a frame having a vertically mounted tubular standard;

a pivot atop the standard, the pivot including a cylindrical bearing block affixed in the tubular standard, and a rod having a vertically oriented spindle journaled in the bearing block, the rod extending above the bearing block and bent to form a member extending laterally outward with respect to the vertically oriented spindle at an angle slightly above horizontal, the frame further including a tubular arm affixed coaxially to the outward extending member of the rod and extending outward from the pivot; and a rectangular panel secured to the frame, the panel having a height substantially greater than its width, the panel being made of a flexible fabric and including looped straps affixed to corners of the panel on and normal to a top edge and one side edge of the panel, the panel being suspended from the outward extending arm by the looped straps on the top edge of the panel and loosely attached to the standard by the looped straps on the one side edge of the panel to allow rotation of the panel about the standard as the outward extending arm rotates about the spindle of the pivot, the rectangular panel having a weight such that the weight of the panel bearing on the arm stresses the outward extending member of the rod and the arm to a normal orientation with respect to the vertically mounted standard.

8. The kinetic banner display according to claim 7 wherein the bearing block includes a ball bearing in which the spindle is journaled.

9. The kinetic banner display according to claim 7 wherein the bearing block includes a thrust bearing in which the spindle is journaled.

* * * * *